United States Patent [19]

Yamada et al.

[11] 4,160,404

[45] Jul. 10, 1979

[54] ELECTRONIC MUSICAL INSTRUMENT

[75] Inventors: Shigeru Yamada; Eiichiro Aoki, both of Hamamatsu, Japan

[73] Assignee: Nippon Gakki Seizo Kabushiki Kaisha, Hamamatsu, Japan

[21] Appl. No.: 844,463

[22] Filed: Oct. 21, 1977

[30] Foreign Application Priority Data

Oct. 29, 1976 [JP] Japan ..... 51/130187

[51] Int. Cl.[2] ..... G10H 1/02; G10H 5/10

[52] U.S. Cl. ..... 84/1.26; 84/1.24; 84/1.03; 84/DIG. 22; 84/1.01

[58] Field of Search ..... 84/1.01, 1.03, 1.17, 84/1.24, DIG. 22, 1.13, 1.26

[56] References Cited

U.S. PATENT DOCUMENTS

| | | | |
|---|---|---|---|
| 3,902,396 | 9/1975 | Hiyoshi | 84/1.24 |
| 3,954,038 | 5/1976 | Adams | 84/1.03 |
| 3,979,989 | 9/1976 | Tomisawa | 84/1.01 |
| 3,999,458 | 12/1976 | Suzuki | 84/1.01 |
| 4,059,039 | 11/1977 | Carlson | 84/1.01 |

*Primary Examiner*—J. V. Truhe
*Assistant Examiner*—William L. Feeney
*Attorney, Agent, or Firm*—Spensley, Horn, Jubas & Lubitz

[57] ABSTRACT

An electronic musical instrument comprising a plurality of tone forming systems having mutually different tone production modes. One of such tone forming systems can produce a tone continuously while another of such systems can produce a tone intermittently. Further, in a case where a plurality of tones are to be produced, one of such systems can produce these tones intermittently one tone after another while another of such systems can produce these tones simultaneously and intermittently. By producing tones from such systems of different tone production modes, an intricate musical tone effect is obtained.

7 Claims, 6 Drawing Figures

ELECTRONIC MUSICAL INSTRUMENT

BACKGROUND AND SUMMARY OF THE INVENTION

This invention relates to an electronic musical instrument and, more particularly, to an electronic musical instrument capable of producing musical tones from a plurality of tone forming systems in a mutually different manner.

In a conventional electronic musical instrument, a musical tone is produced in a certain predetermined tone production mode. For example, production of a tone is started upon depression of a key, sustained while the key is kept depressed and caused to decay after release of the key. Assuming, for another example, a case where a piano tone is simulated, the production of the tone is started at a maximum level and caused to decay thereafter. In this manner, the tone production by the conventional electronic musical instrument tends to be a monotonous one which solely depends upon manipulation of the key It is therefore an object of the present invention to provide an electronic musical instrument capable of producing an intricate musical tone effect by providing a plurality of musical tone forming system which have mutually different tone production modes. According to one aspect of the invention, the instrument employs one tone production mode in which a musical tone is intermittently produced at a regular interval and another tone production mode in which a musical tone is continuously produced. By separately controlling the tone production in the different tone forming systems in accordance with the above described tone production modes, the musical tone produced in these different tone production modes are mixed together and an intricate musical tone effect is thereby produced. Further, it is possible, according to another aspect of the invention, to control the tone production in such a manner that a plurality of tones are produced simultaneously in one musical tone forming system while tones are produced one tone after another in another tone forming system so as to produce an intricate musical tone effect.

The timing of producing a tone intermittently can be automatically controlled by employing an automatic bass/chord performance control device or an automatic arpeggio performance control device. The automatic arpeggio performance is also called as "chord pyramid performance" because, in arpeggio, tones constituting a chord are sequentially produced one after another in the order of the tone pitch of these tones with a result that the tone pitch of the produced tones rises and falls in the form of a pyramid.

Further, according to still another aspect of the invention a tone volume envelope of the intermittently produced tones can be switched to either of a percussion type envelope and a sustain type one. By such switching of the envelope, the musical tone effect of the produced tone may be varied.

The above and other objects and features of the invention will become apparent from the description made hereinbelow in conjunction with the accompanying drawings.

BRIEF DESCRIPTION OF THE DRAWINGS

In the accompanying drawings.

DESCRIPTION OF THE PREFERRED EMBODIMENTS

Figure 1:
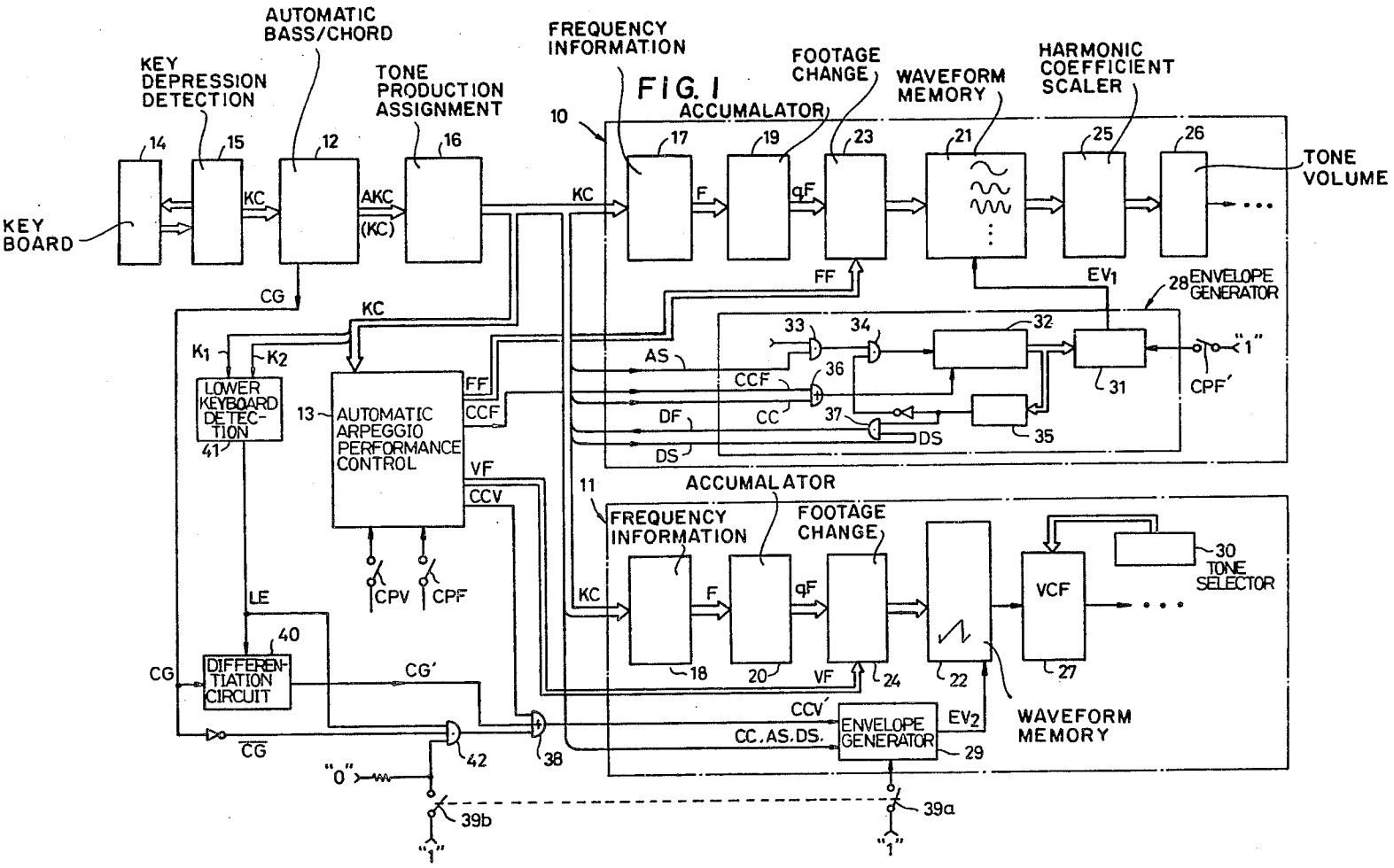
FIG. 1 is a block diagram showing one embodiment of the present invention.

The electronic musical instrument shown in FIG. 1 includes two separate musical tone forming systems 10 and 11 which produce musical tones by mutually different methods. In the present embodiment, the musical tone forming system 10 produces a musical tone of a tone color simulating a flute by a harmonics synthesizing method while the musical tone forming system 11 produces a musical tone of an intricate tone color by controlling the tone color of a tone source waveform signal by means of a voltage-controlled type filter (VCF) and the like. The electronic musical instrument of the present embodiment includes an automatic bass/-chord performance control device 12 and an automatic arpeggio performance control device 13. The mode of production of musical tones produced by the musical tone forming systems 10 and 11 is automatically switched depending upon the operation state of these automatic performance control devices 12 and 13.

Referring to FIG. 1, a keyboard 14 comprises, for example, an upper keyboard, a lower keyboard and a pedal keyboard. A depressed key detection circuit 15 detects a key depressed on the keyboard 14 and produces a key code KC representing the depressed key. The key code KC is made up, for example, of a 9-bit code consisting of a 2-bit keyboard code $K_1$ and $K_2$ representing a keyboard kind, a 3-bit octave code $B_1$, through $B_3$ representing an octave range and a 4-bit note code $N_1$ through $N_4$ representing twelve notes in one octave. An example of such key code is shown in the following Table 1.

Table 1

| Key name | | Key code KC | | | | | | | | |
|---|---|---|---|---|---|---|---|---|---|---|
| | | $K_2$ | $K_1$ | $B_3$ | $B_2$ | $B_1$ | $N_4$ | $N_3$ | $N_2$ | $N_1$ |
| Keyboard | Upper | 0 | 1 | | | | | | | |
| | Lower | 1 | 0 | | | | | | | |
| | Pedal | 1 | 1 | | | | | | | |
| Octave range | 1st | | | 0 | 0 | 0 | | | | |
| | 2nd | | | 0 | 0 | 1 | | | | |
| | 3rd | | | 0 | 1 | 0 | | | | |
| | 4th | | | 0 | 1 | 1 | | | | |
| | 5th | | | 1 | 0 | 0 | | | | |
| | 6th | | | 1 | 0 | 1 | | | | |
| | C# | | | | | | 0 | 0 | 0 | 0 |
| | D | | | | | | 0 | 0 | 0 | 1 |
| | D# | | | | | | 0 | 0 | 1 | 0 |

Table 1-continued

| Key name | | Key code KC | | | | | | | | |
|---|---|---|---|---|---|---|---|---|---|---|
| | | $K_2$ | $K_1$ | $B_3$ | $B_2$ | $B_1$ | $N_4$ | $N_3$ | $N_2$ | $N_1$ |
| Note | E | | | | | | 0 | 1 | 0 | 0 |
| | F | | | | | | 0 | 1 | 0 | 1 |
| | F# | | | | | | 0 | 1 | 1 | 0 |
| | G | | | | | | 1 | 0 | 0 | 0 |
| | G# | | | | | | 1 | 0 | 0 | 1 |
| | A | | | | | | 1 | 0 | 1 | 0 |
| | A# | | | | | | 1 | 1 | 0 | 0 |
| | B | | | | | | 1 | 1 | 0 | |
| | C | | | | | | 1 | 1 | 1 | 0 |

The key code KC delivered out of the depressed key detection circuit 15 is applied to a tone production assignment circuit 16 through the automatic bass/chord performance control device 12. The device 12 is provided for controlling an automatic bass performance and an automatic chord performance in such a manner that automatic chord tones are produced as lower keyboard tones whereas automatic bass tones are produced as pedal keyboard tones. If the automatic bass chord performance is selected, a key code or codes AKC for a tone or tones required for conducting the bass performance and the chord performance are automatically produced on the basis of a key code KC which corresponds to the depressed key, for example, on the lower keyboard and which is supplied from the depressed key detection circuit 15. In other words, the automatic bass/chord performance control device 12 automatically produces, on the basis of the key code KC for the key actually depressed on the keyboard, a key code or codes AKC for a key or keys which actually are not depressed as if the key or keys for the key code or codes AKC were depressed. The key code or codes AKC thus produced are supplied to the tone production assignment circuit 16.

In the case of an ordinary automatic bass/chord performance, the lower keyboard is used as the keyboard for playing the chord tones. The key codes for one or more keys depressed on the lower keyboard therefore are supplied to the tone production assignment circuit 16 via the automatic bass/chord performance control device 12. At this time, the automatic bass/chord performance control device 12 produces a chord tone production timing signal CG in accordance with a rhythm selected by a performer. Each time this chord tone production timing signal CG is produced, the lower keyboard tones are simultaneously produced (i.e., as the chord tones). In the automatic bass/chord performance control device 12, a chord name for a chord constituted by one or more keys depressed on the lower keyboard in the form of a chord is detected, and the generation of the automatic bass tones is controlled in accordance with this chord name and a desired bass pattern. In other words, the key code or codes AKC for a tone or tones to be produced as the automatic bass tone are automatically produced as a key code or codes for the pedal keyboard and are outputted at a timing of the desired bass pattern.

The tone production assignment circuit 16 receives the key code KC provided by the depressed key detection circuit 15 or the key code AKC provide by the automatic bass chord performance control device 12 and thereupon assigns production of the tone for the key represented by the key code to one of channels equal in number to the maximum number of tones to be produced simultaneously (e.g. twelve tones). The tone production assignment circuit 16 has storage positions corresponding to the respective channels, stores a key code at a storage position corresponding to a channel to which the tone production for the key has been assigned and sequentially delivers out time-division multiplexes key codes KC stored in the respective channels.

In the present embodiments, counters, logical circuits and memories are constructed in dynamic logic so that these component parts can be commonly used in time-division manner for enabling simultaneous production of a plurality of tones. Accordingly, time relation between clock pulses controlling operations of these component parts is very important which is now explained with reference to FIG. 2.

Figure 2:
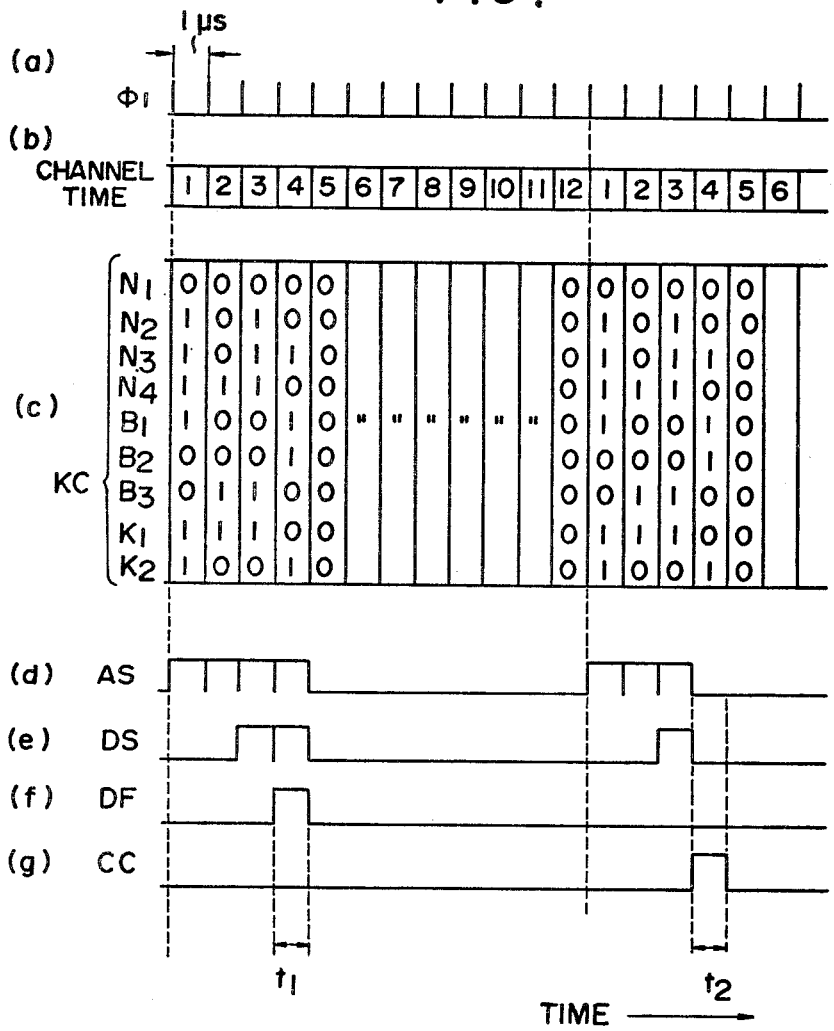
FIG. 2 is a time chart for explaining the operation of a tone production assignment circuit in the embodiment shown in FIG. 1.

In FIG. 2, (*a*) shows a main clock pulse $\phi_1$ used for controlling time-division operations of the respective channels and having a period of 1 microsecond ($10^{-6}$ sec.). Since there are twelve channels in this embodiment, time slots defined by the main clock pulse $\phi_1$ and each having width of 1 microsecond are made to correspond sequentially to the first through twelfth channels. The respective time slots are hereinafter referred to as the first channel time through the twelfth channel time, as shown in FIG. 2(*b*). Each of these channel times occurs circulatingly. Accordingly, the key code KC representing a key whose tone production has been assigned by the tone production assignment circuit 16 is sequentially provided in synchronism with the channel time of the assigned channel. Assuming for example, that the note C of the second octave on the pedal keyboard has been assigned to the first channel, the note G of the fifth octave on the upper keyboard to the second channel, the note C of the fifth octave on the upper keyboard to the third channel, the note E of the fourth octave on the lower keyboard to the fourth channel and no tone production has been assigned to the rest of the channels (fifth through channels), contents of the key codes KC are as shown in FIG. 2(*c*) in which the outputs of the fifth through the twelfth channels are all signal "0".

The tone production assignment circuit 16 produces in a time division manner an attack start signal (or a key-on signal). As representing that tone production should be made in a channel to which the tone production of a depressed key has been assigned in synchronism with the channel time corresponding to the assigned channel. The circuit 16 also produces a decay start signal (or a key-off signal) DS representing that the key whose tone production was assigned to a specific channel has been released (i.e., supply of the key code KC or the key code AKC from the depressed key detection circuit 15 has ceased) in synchronism with the channel time corresponding to the channel. These signals AS and DS are utilized for controlling the amplitude envelope of the musical tone. Furthermore, the tone production assignment circuit 16 receives from an envelope generator described later a decay finish signal DF representing that the tone production in the channel has finished and produces, in response to this decay finish signal DF, a clear signal CC which clears various stored data concerning the channel and thereby cancels assignment of the tone production in this channel. In the example shown in FIG. 2 (*c*), if the keys assigned to the first and second channels are presently being depressed, the keys assigned to the third and fourth channels have been released with the tones for these keys being in a decaying state, and in the fourth channel the decay finish signal DF is generated at a time slot $t_1$ and the clear signal CC is generated at a time slot $t_2$ which is later by 12 channel times, the signals AS, DS, DF and CC shown in FIG. 2(*d*) through FIG. 2(*g*) are produced. Since the clear signal CC is produced at the time slot $t_2$, the attack start signal AS and the decay start signal DS in the fourth channel are cancelled at the time slot $t_2$. At this time, the key code KC in the fourth channel in FIG. 2(*c*) is cancelled, through it is present in the figure for convenience of description.

The key code KC, the attack start signal AS and the decay start signal DS outputted from the tone production assignment circuit 16 are supplied to the musical tone forming systems 10 and 11 and the automatic arpeggio performmance control device 13.

The automatic arpeggio performance control device 13 is a device capable of automatically conducting a performance resembling arpeggio. In this device 13, the key code for the lower keyboard among the key codes supplied from the assignment circuit 16 KC is sequentially selected in the order of the tone pitch at a predetermined timging and, in synchronism with the channel time for the channel to which the selected key code KC is assigned, automatic arpeggio tone production command signals CCF and CCV are generated. The automatic arpeggio tone production command signal CCF is supplied to an envelope generator 28 of the musical tone forming system 10, whereas the automatic arpeggio tone production command signal CCV is supplied to an envelope generator 29 of the musical tone forming system 11. In the musical tone forming systems 10 and 11, the amplitude envelope of the musical tone is controlled in accordance with these signals CCF and CCV and lower keyboard tones only for the channels in which these signals CCF and CCV have been generated are produced among lower keyboard tones assigned to the respective channels. Accordingly, by operating the automatic arpeggio performance control device 13, a tone associated with the key depressed on the lower keyboard of the keyboard 14 or a tone associated with the key code AKC for the automatic chord performance which has been automatically produced by the automatic bass/chord peformance control device 12 is automatically played in the form of arpeggio. In the automatic arpeggio performance employing the automatic arpeggio performance control device 13, the octave of the produced tone is also changed automatically and, for this purpose, octave change signals FF and VF representing the amount of octave change are provided by the device 13. The tone pitch of the arpeggio tone is changed on the octave basis in accordance with the values of the octave change signals FF and FV.

In the musical tone forming systems 10 and 11, the key code KC provided by the tone production assignment circuit 16 is used as an address designation signal for designating an address for reading from frequency information memories 17 and 18 frequency information F corresponding to a musical tone frequency of the tone associated with the key code KC.

The frequency information memories 17 and 18 store in advance frequency information F (constants) corresponding to the key codes KC of the respective keys. These memories 17 and 18 are composed, for example, of read-only memories. When a certain key code KC is applied to the memories 17 and 18, frequency information F stored at an address designated by the key code KC is read out. The frequency information F is regularly and successively accumulated by accumulators 19 and 20 and determines the sampling points for sampling the amplitude of a tone source waveform at a predetermined interval. Accordingly, the frequency information F is a digital value proportional to the musical tone frequency for the key. The value of the frequency information F is determined if the value of the musical tone frequency is determined at a certain constant sampling speed. Assuming that sampling of one tone source waveform has been completed when a value qF (where q = 1, 2, 3 . . .) obtained by successively accumulating the frequency information F by the accumulators 19 and 20 has reached 64 in a decimal notation and that this accumulation is completed every 12 microseconds in which one circulation of the entire channel times is completed, the value of the frequency information F is determined by an equation $$F = 12 \pm 64 \times f \times 10^{-6}$$

where f is a frequency of the musical tone. This value F is stored in the frequency information memories 17 and 18. in accordance with the frequency f to be obtained.

The accumulators 19 and 20 are composed of counters which cumulatively add the frequency information F of the respective channels at a predetermined sampling rate (i.e., at a rate of 12 microseconds for each channel time) to obtain a cumulative value qF and thereby advance the phase of the tone source waveform. When the cumulative value qF has reached 64 in a decimal notation, thee accumulators overflow and return to 0 thereby completing reading out of one waveform. For accumulating data F of the respective channels, each of the accumulators 19 and 20 may preferably be composed of an adder of plural stages and a shift register of 12 stages corresponding to the number of the channels.

The tone source waveform is divided into a plurality of sample points (e.g. 64) and amplitude values at respective sample points are stored in the respective addresses of waveform memories 21 and 22. The value qF which is the output of each of the accumulators 19 and 20 constitutes an input designating the address to be called in each of the memories 21 and 22.

Tone source waveforms of tones assigned to the respective channels are read out in a time division manner from the waveform memories 21 and 22 in response to the value qF provided in time division for each of the channels.

Footage change circuits 23 and 24 inserted between the accumulators 19 and 20 and the tone source waveform memories 21 and 22 are constructed in such a manner that a binary bit position of the cumulative value qF outputted from each of the accumulators 19 and 20 is suitably shifted in accordance with the octave change signal FF or VF. The output qF of each of the accumulators 19 and 20 is applied directly to a corresponding one of the waveform memories 21 and 22 if the octave change is not designated. If the octave change has been designated by the signal FF or VF, the value qF is converted to a value which is double, four times or eight times . . . as large as the original value in accordance with the amount of the octave change and thereafter is applied to the corresponding waveform memories 21 or 22.

By converting the value qF to a value which is double, four times or eight times . . . as large as the original value by the footage change circuits 23 and 24, a sampled amplitude value at an address which is advanced by double, four times, eight times . . . from the address designated by the original value qF is read from the waveform memories 21 and 22. This means that the musical tone frequency obtained becomes double, four times, eight times . . . and, accordingly, the tone pitch of the produced tone is raised by one octave, two octaves, three octaves, etc.

The octave change signals FF and VF for designating the amount of octave change are provided by the automatic arpeggio performance control device 13.

The signal FF designates the number of the octave change in the musical tone forming system 10, whereas the signal VF designates the number of the octave change in the musical tone forming system 11. Accordingly, the automatic arpeggio performance can be conducted separately in these two musical tone forming systems.

In the musical tone forming system 10, the waveform memory 21 includes a plurality of tone source waveform memories storing respective harmonics of sinusoidal waves and respective harmonic waveforms are simultaneously read out in response to the address signal from the accumulator 19 through the footage change circuit 23. A harmonic coefficient scaler 25 is a circuit for individually controlling relative amplitudes of the read out harmonic waveforms. The amplitude controlled harmonics are added together to form musical tone signals of various tone colors. In a tone volume 26, a desired one out of the musical tone signals of various tone colors outputted from the harmonic coefficient scaler 25 is selected. In this manner, a musical tone of a desired tone color is obtained in the musical tone forming system 10 by the harmonics synthesizing method.

In the musical tone forming system 11, the waveform memory 22 stores a tone source waveform, e.g. a sawtooth waveform, which contains abundant harmonic contents. The tone source waveform read from the waveform memory 22 is applied to a voltage-controlled type filter (VCF) 27 for effecting a tone color control. The tone color control characteristic in the voltage-controlled type filter 27 is variably controlled in accordance with a desired tone color selected by a tone selector 30.

Generation of the musical tone in the musical tone forming systems 10 and 11 is controlled by envelope shape signals $EV_1$ and $EV_2$ supplied by envelope generators 28 and 29. More specifically, tone source waveform signals having maximum amplitudes corresponding to the levels of the envelope shape signals $EV_1$ and $EV_2$ are read out of the waveform memories 21 and 22. An example of construction of the envelope generators 28 and 29 is schematically shown in the block of the generator 28. An envelope memory 31 stores in advance an amplitude envelope of a musical tone corresponding to variation with time of the tone level. A reading address of the envelope memory 31 is advanced in accordance with the count output of an envelope counter 32. A clock for advancing the envelope counter 32, i.e., for advancing the reading address of the envelope memory 31, is supplied to the counter 32 through AND gates 33 and 34. The AND gate 33 receives clock pulse at one input thereof and at the other input thereof the attack start signal AS. When the count of the counter 32 has amounted to a final address of the envelope memory 31, a final address detection logic 35 produces an output "1" whereby delivery of the clock is prevented by the AND gate 34. Upon application of the automatic arpeggio tone production the designation signal CCF to the counter 32 through an OR gate 36, the counter 32 is cleared and the reading address of the envelope memory 31 becomes 0. When the signal CCF falls (becomes "0"), the counter 32 starts counting from the address 0 if the attack start signal AS has been provided to the counter, and then the envelope signal $EV_1$ is read from the envelope memory 31.

In conducting the automatic arpeggio performance, the tone production timing is controlled by the automatic arpeggio tone production command signal CCF (or CCV), whereas in the ordinary performance in which the automatic arpeggio performance is not conducted, the tone production timing is controlled by the clear signal CC. More specifically, when the clear signal CC has fallen from "1" to "0" and the attack start signal AS rises from "0" to "1" upon depression of the key, the counter 32 starts its operation and the envelope signal $EV_1$ is thereby produced. When the final address N has been detected by the final address detection logic 35, a decay finish signal DF is provided through an AND gate 37 to the tone production assignment circuit 16 if the decay start signal DS representing release of the key is present.

The envelope counter 32 is so constructed that it will perform the counting operation in a time division manner and, accordingly, the envelope signals $EV_1$ and $EV_2$ are generated for the respective channels in time division.

The other envelope generator 29 may be constructed in the same manner as the envelope generator 28. In the envelope generator 29, an output signal CCV' of an OR gate 38 (the automatic arpeggio tone production command signal CCV) is employed to clear the envelope counter 32.

Figure 3:
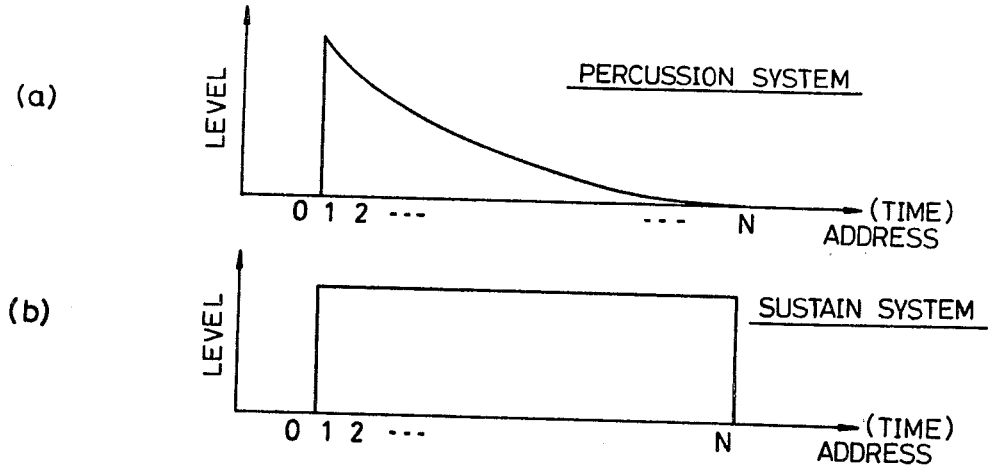
FIG. 3 is a graphical diagram showing an example of envelope shapes which are selectively producible in an envelope generator in the same embodiment.

An enevelope shape of a percussion characteristic as shown in FIG. 3(*a*) and an envelope shape of a sustain characteristic as shown in FIG. 3(*b*) are selectively produced by the respective envelope generators 28 and 29. The envelope memory 31 stores these two kinds of envelope shapes and one of them is selectively read out.

Figure 4:
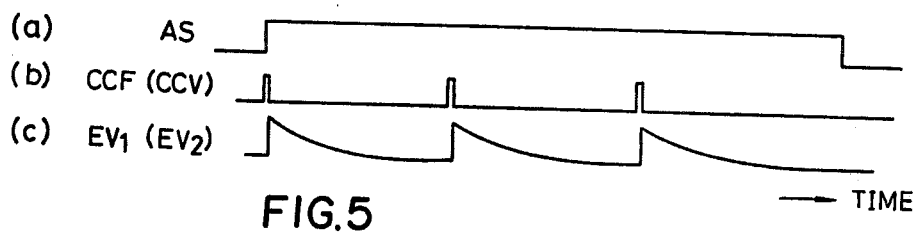
FIG. 4 is a time chart for explaining the manner in which an envelope signal of a percussion characteristic is produced in response to an automatic arpeggio tone production command signal.

As for the envelope of a percussion characteristic shown in FIG. 3(*a*), the level of a maximum value at address 1 is read out when the counter 32 is released from the reset state and, upon application of a count pulse to the counter 32, the count of the counter 32 has become 1. The level of the envelope decreases subsequently to the final address N at which the level becomes 0 and generation of the tone ceases. FIG. 4 shows, with respect to one channel time only, a manner in which the envelope signal $EV_1$ (or $EV_2$) of a percussion characteristic is produced on the basis of the automatic arpeggio tone production command signal CCF (or CCV). As shown in FIG. 4 (*b*), the envelope counter 32 is cleared upon receipt of a shot of the pulse signal CCF (or CCV) whereby the count of the counter 32 becomes 0. Accordingly, if the attack start signal AS is present (FIG. 4(*a*)), the count pulse is supplied to the envelope counter 32 and thereupon the signal CCF (or CCV) falls to "0" and the counter 32 performs the counting to produce the percussion type envelope signal $EV_1$ (or $EV_2$). When the reading address has reached the final address N, and AND gate 34 is disenabled so that the counter 32 holds the count value at the final address N. Accordingly, the level of the envelope signal $EV_1$ (or $EV_2$) is sustained at the zero level. Upon receipt of another shot of the signal CCF (or CCV), the counter 32 is cleared to 0 whereby the count pulse is supplied to the counter 32. Accordingly, the percussion type envelope signal $EV_1$ (or $EV_2$) is generated at a timing of generation of the automatic arpeggio tone production command signal CCF or CCV, and a musical tone is produced intermittently and repeatedly.

The level of the envelope shape of a sustain characteristic shown in FIG. 3(*b*) becomes maximum when the counter 32 is released from the reset state and thereupon the count pulse is supplied to the counter 32 and the count thereof has become 1. Subsequently, the maximum level is sustained to the final address N. Accordingly, the maximum level is sustained even after stopping of advance of the reading address in the envelope memory 31 so that the tone production is maintained. When the counter 32 is cleared and the count thereof becomes 0, the envelope level also becomes 0.

In the envelope generator 28 in the muscial tone forming system 10, the shape of the envelope signal $EV_1$ is switched in accordance with a state of an automatic arpeggio performance selection switch CPF for the harmonics synthesizing system.

In a case where the automatic arpeggio tone is produced in the musical tone forming system 10, the selection switch CPF is switched to an "ON" state in which the octave change signal FF and the automatic arpeggio tone production command signal CCF for the harmonics synthesizing system can be generated. At this time, a switch CPF' interlocked with the switch CPF also is switched to an "ON" state to cause a signal "1" to be applied to the envelope memory 31 and thereby switch the envelope shape to be read from the envelope memory 31 to a percussion type one (FIG. 3 (*a*)). If the automatic arpeggio performance by using the musical tone forming system 10 is not performed, the switches CPF and CPF' are switch to an "OFF" state to prevent generation of the signals FF and CCF. In this case, the envelope shape to be read from the envelope memory 31 is switched to a sustain type one (FIG. 3(*b*)).

In the envelope generator 29 in the musical tone forming system 11, the shape of the envelope signal $EV_2$ is switched in accordance with a tone color selected by a tone selector 30. Envelope selection switches 39*a* and 39*b* which are interlocked with each other are operated in association with the operation state of tone color selection switches (not shown) provided in the tone selector 30. If a tone color of the percussion type envelope is selected by the tone selector 30, the switches 39*a* and 39*b* are switched to an "OFF" state. In this case, the envelope generator 29 generates the percussion type envelope shape (FIG. 3(*a*)) as the envelope signal $EV_2$. If a tone color of the sustain type envelope is selected by the tone selector 30, the switches 39*a* and 29*b* are switched to an "ON" state and the envelope signal $EV_2$ produced by the envelope generator 29 is switched to the sustain type envelope shape (FIG. 3 (*b*)).

In switching the envelope shape, the rate of the clock pulse applied to the AND gate 33 should be suitably changed, though a detailed description is omitted.

In a case where the automatic arpeggio tone is generated by the musical tone forming system 11, an automatic arpeggio performance selection switch CPV for the filter system is switched to an "ON" state in which the automatic arpeggio tone production command signal CCV for the filter system can be produced by the automatic arpeggio performance control device 13.

If the automatic arpeggio performance and the automatic bass/chord performance are to be conducted simultaneously in the above described embodiment, the automatic arpeggio tone is produced by the harmonics synthesizing system musical tone forming system 10 and the automatic bass/chord tone is produced by the filter system musical tone forming system 11. For this purpose, arrangements are made so that the signals VF and CCV will not be produced even if the chord pyramid performance selection switch CPV for the filter system is switched to an "ON" state, though a detailed description in this respect is omitted.

Figure 5:
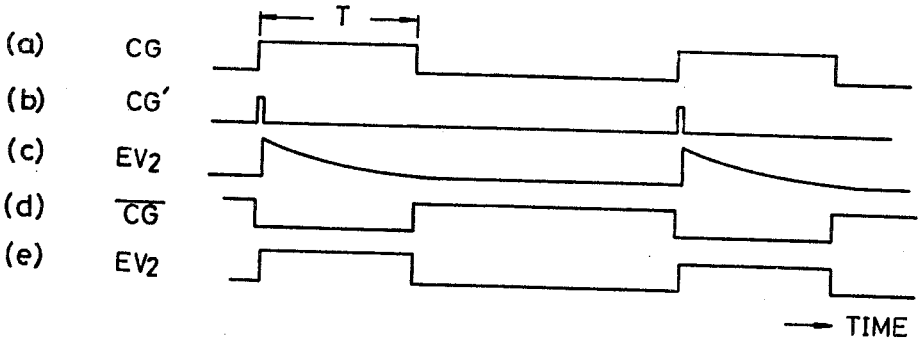
FIG. 5 is a time chart for explaining the manner in which an envelope signal of a percussion characteristic and an envelope signal of a sustain characteristic are produced in response to a chord tone production timing signal CG.

The chord tone production timing signal CG provided by the automatic bass/chord peformance control device 12 is generated with a constant time width T at the timing for producing the chord tone as shown in (a) of FIG. 5. In the present embodiment, the percussion type envelope is generated by providing one shot of the tone production command signal at the start of tone production. For this purpose, the chord tone production timing signal CG is applied to a differentiation circuit 40 to cause it to produce a differentiated pulse with a time width of 12 channel times and this differentiated pulse is selected by a lower keyboard detection signal LE provided by a lower keyboard detection circuit 41 in synchronism with a channel time to which production of the lower keyboard tone (i.e., the tone constituting the chord) is assigned, whereby one shot of chord tone production command signal CG' is obtained. For convenience of explanation, the signal CG' in FIG. 5 (*b*) is depicted as if only one shot thereof was produced at the time of rising of the signal CG, but actually it is produced by ones at each channel time to which the lower keyboard tone is assigned in a time division manner. This chord tone production command signal CG' is applied to the envelope generator 29 via the OR gate 38 to clear the envelope counter 32. Accordingly, the percussion type envelope signal $Ev_2$ as shown in FIG. 5 (*c*) is generated in time division with respect to each channel to which the tone production of the lower keyboard tone is assigned.

In a mode in which the sustain type envelope shape is generated in the envelope generator 29, the envelope selection switch 39*b* is in an "ON" state as was previously described. Accordingly, a signal "1" is applied to an AND gate 42 via the switch 39*b*. The AND gate 42 receives at other inputs thereof a signal $\overline{CG}$ (FIG. 5(*d*)) obtained by inverting the chord tone production timing signal CG and the lower keyboard detection signal LE. The output of the AND gate 42 is applied as the clear signal CCV' to a clear input of the envelope counter 32 of the envelope generator 29. Accordingly, the clear input of the envelope counter 32 is "0" during the time width T of the timing signal CG so that the counter 32 is not cleared. Accordingly, if the attack start signal AS is "1", the sustain type envelope signal $EV_2$ is generated in coincidence with the signal CG as shown in FIG. 5(*e*). Upon turning of the signal CG to "0", the inverted signal $\overline{CG}$ becomes "1" to enable the AND gate 42 which outputs a signal "1" in synchronism with the channel in which the lower keyboard detection signal LE is "1". This output of the AND gate 42 clears the envelope counter 32 of the envelope generator 39. Accordingly, the sustain type envelope signal $EV_2$ is not produced when the chord tone timing signal CG is not generated.

The lower keyboard detection circuit 41 receives the keyboard codes $K_1$ and $K_2$ among the key code KC provided by the tone production assignment circuit 16 and generates the signal LE in synchronization with the channel time to which production of the lower keyboard tone is assigned. This is because the automatic tone control is effected with respect to the lower keyboard tones (the cord tones and automatic arpeggio tones) in the present embodiment. Since the chord tone production timing signal CG is generated in dc-wise, the lower keyboard detection signal LE is used to convert the signal CG to a time division multiplexed signal.

Relationship of the automatic bass/chord performance and the automatic arpeggio performance with the tone production mode in the musical tone forming systems 10 and 11 is described below.

(1) The case in which the automatic bass/chord performance only is selected.

Since in this case the automatic arpeggio performance selection switch CPF (CPF') is in an "OFF" state, the envelope generator 28 of the musical tone forming system 10 produces the sustain type envelope signal $EV_1$. In this case, the automatic arpeggio tone production command signal CCF is not produced so that the envelope signal $EV_1$ is generated in correspondence to the depression of the key on the keyboard 14 and in response to the attack start signal AS and the decay start signal DS. Accordingly, in the musical tone forming system 10, the tone of the key depressed on the keyboard is continuously produced in accordance with the key depression without any modification (See FIG. 6(*a*)). If, for instance, the keys for the notes $C_4$, $E_4$ and $G_4$ are being depressed on the lower keyboard, the tones for the notes $C_4$, $E_4$ and $G_4$ are simultaneously and continuously produced. This gives rise to a musical tone effect resembling progress of melody according to counter point.

Figure 6:
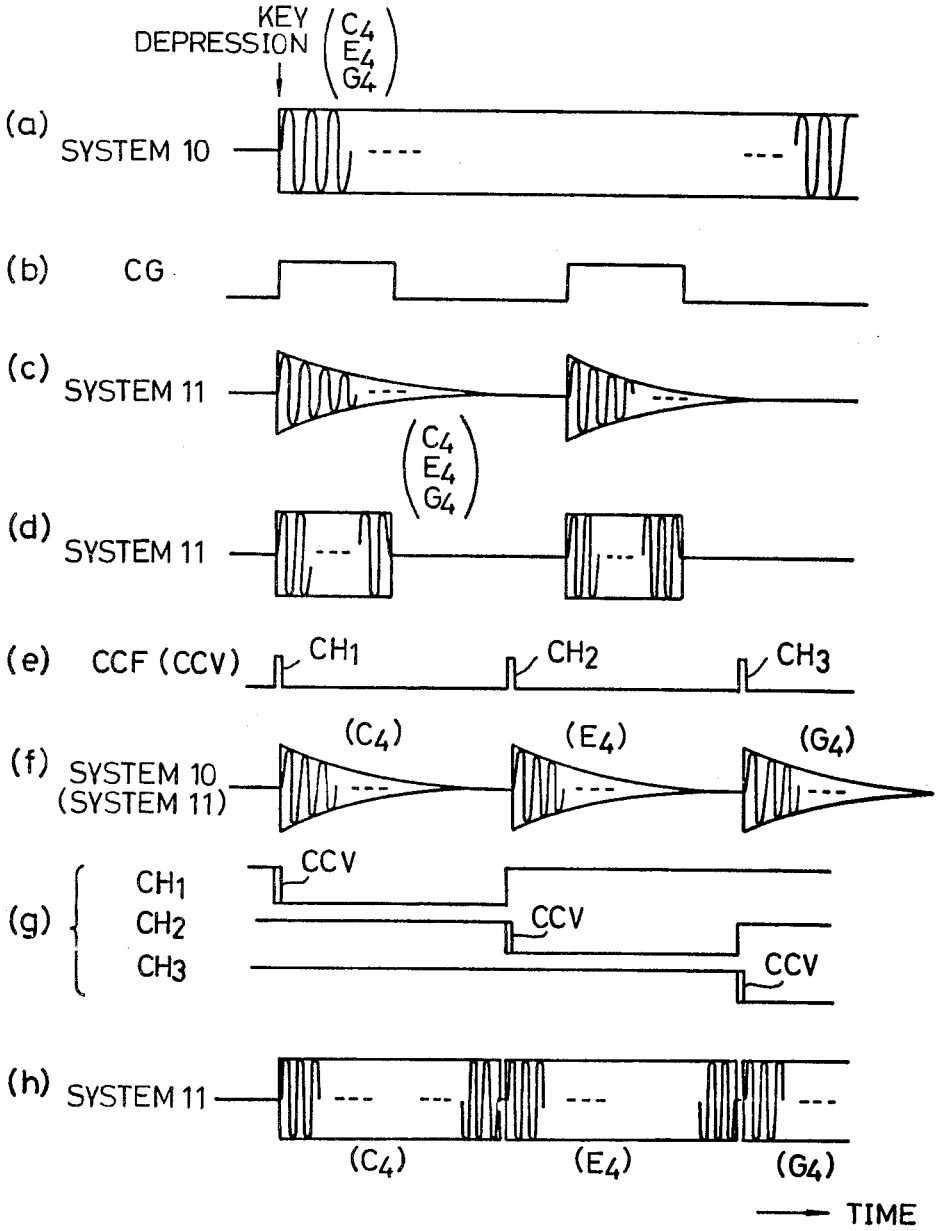
FIG. 6 is a time chart showing examples of tone production in respective musical tone forming systems.

In the musical tone forming system 11, the envelope generator 29 generates the envelope signal $EV_2$ in accordance with the chord tone production timing signal CG (FIG. 6(*b*)) and, accordingly, the lower keyboard tones, i.e. the chord tones ($C_4$, $E_4$ and $G_4$) are produced intermittently and simultaneously in the form of a percussion type decaying tone as shown in FIG. 6(*c*) if the envelope selection switches 39*a* and 39*b* are in an "OFF" state. If the envelope signal $EV_2$ of the sustain type has been selected, the lower keyboard tones ($C_4$, $E_4$ and $G_4$) are produced intermittently and simultaneously in the form of a sustained tone as shown in FIG. 6 6(d) with a time width corresponding to the time width of the signal CG. The intermittent tone control in the musical tone forming system 11 gives rise to a musical tone effect resembling chord tones played by a guitar.

(2) The case in which the automatic arpeggio performance only is selected:

The envelope signal $Ev_1$ in the musical tone forming system 10 is switched to the percussion type envelope. Accordingly, in the musical tone forming system 10, the automatic arpeggio tones as shown in FIG. 6(*f*) are produced in the form of a decaying tone in response to the automatic arpeggio tone production command signal CCG (CCV) generated as shown FIG. 6(*e*). Since the automatic arpeggio tones are produces one after another, the signals CCF (CCV) shown in FIG. 6(*e*) are of different channels, e.g. the signal $CH_1$ for the first channel, the signal $CH_2$ for the second channel and the signal $CH_3$ for the third channel respectively. If, for example, the tones for the keys depressed on the lower keyboard ($C_4$, $E_4$ and $G_4$) are produced sequentially from the lowest tone, the $C_4$ tone is produced first and followed by the $E_4$ and $G_4$ tones.

In a case where the percussion type envelope signal $EV_2$ is generated in the musical tone forming system 11, the tone is produced in the same manner as in the musical tone forming system 10. If, however, the sustain type envelope has been selected in the system 11, the tone is continuously produced without decay as shown in FIG. 6(*h*), the tone pitch of the produced tone being changed sequentially. FIG. 6(*g*) shows the state of the actual automatic arpeggio tone production command signal CCV for the filter system with respect to the respective channels $CH_1$, $CH_2$ and $CH_3$. When the signal CCV falls at a certain channel and a tone is being produced in that channel, the signals CCV in other channels are "1" continuously to always clear the counter 32. Accordingly, until the signal CCV falls to "0" in a channel in which the tone production is to be made nextly, the signal CCV for the preceding tone maintains the "0" state to continue the tone production without clearing the counter 32. Immediately before the sustain type envelope signal $EV_2$ is generated in the next channel, the sustain type envelope signal $EV_2$ in the preceding channel in which the tone was produced is cancelled.

(3) The case in which both the auotmatic bass/chord performance and the automatic arpeggio performance are selected: Since the automatic arpeggio tone is produced in the musical tone forming system 10, tones for the keys depressed on the lower keyboard are sequentially produced one after another as shown in FIG. 6(*f*). This gives rise to a musical tone effect resembling playing the piano or harp to sound one tone after another.

Since the automatic chord tone are produced in the musical tone forming system 11, a plurality of tones for the keys depressed on the keyboard are simultaneously and intermittently produced as shown in FIG. 6(*c*) or 6(*d*). This gives rise to a musical tone effect resembling playing of a chord by a guitar.

What we claim is:

1. An electronic musical instrument comprising:

a plurality of keys;

key identification information generating means responsive to said keys for generating key identification information;

a plurality of musical tone forming systems each producing musical tone signals according to the same key identification information from said key identification information generating means; and means for controlling the simultaneous or sequential order and the envelope shape of the musical tone signals formed by one system independently from, and so as to differ with respect to each of the other musical tone forming system;

the circuitry for establishing the tone color of the musical tone signals in the respective musical tone forming systems being different from the tone color circuitry of each other system.

2. An electronic musical instrument according to claim 1 further comprising:

two different automatic performance devices each connected to said tone forming systems and to said means for controlling, said devices being separately selectable and operative when selected to influence the tones formed by said systems so as to establish mutually different sets of simultaneous or sequential order and envelope shape of the formed musical tone signals upon selection of only one, only the other, or both of said automatic performance devices.

3. An electronic musical instrument according to claim 2 wherein said tone forming systems include a first, harmonic synthesis system and a second voltage controlled filter type system, wherein said automatic performance devices include an automatic bass chord device and an automatic arpeggio device, selection of only said automatic bass device causing said first and second tone forming systems to form musical tones having a first set of tone order and envelope shape characteristics, selection of only said automatic arpeggio device causing said tone forming systems to form musical tones having a second set of tone order and envelope shape characteristics different from said first set, concurrent selection of both said automatic bass chord and said automatic arpeggio devices causing said tone forming systems to form musical tones having a third set of tone order and envelope shape characteristics different from both said first set and said second set.

4. A polyphonic electronic musical instrument comprising:

a note selection circuit, at least two musical tone forming systems each connected to said note selection circuit, each system producing plural musical tones in response to concurrent selection of plural notes by said selection circuit, each system having:

a tone coloring means for imparting a tonal quality to the musical tones formed by said each system which is different from the tonal quality imparted by any other of said systems, and a tone production mode control means for controlling whether said plural tones are produced in a simultaneous or sequential order and for establishing the amplitude envelope characteristics of said produced tones, and at least one automatic performance device connected to said musical tone forming systems, said mode control means having circuitry, responsive to automatic performance selection, for establishing mutually different modes of tone production for each of said systems, said modes differing with respect to order of tone production and/or envelope characteristics.

5. An electronic musical instrument as defined in claim 4 wherein said note selection circuit includes a keyboard, and wherein one of said tone forming systems is a system in which a plurality of tones selected by key depression are produced intermittently and sequentially one by one and another of said tone forming systems is a system in which a plurality of tones selected by key depression are produced simultaneoulsy and intermittently.

6. An electronic musical instrument according to claim 4 having two automatic performance devices, one being an automatic arpeggio device and the other being an automatic bass chord device, said circuitry establishing:

a first tone production mode when said arpeggio device alone is selected, a second tone production mode when said bass chord device alone is selected, and a third tone production mode when both said arpeggio device and said bass chord device are concurrently selected, said first, second and third modes being mutually different.

7. An electronic musical instrument according to claim 6 wherein there are two tone forming systems, and wherein said circuitry:

in establishing said first mode, causes both said tone forming systems to produce said plural tones sequentially and intermittently, in establishing said second mode causes one tone forming system to produce said plural tones simultaneously and continuously and causes said other tone forming system to produce said plural tones simultaneously and intermittently, and in establishing said third mode causes one tone forming system to produce said plural tones sequentially and intermittently and causes said other tone forming system to produce said plural tones simultaneously and intermittently.

* * * * *